United States Patent [19]

Fairbairn

[11] 4,004,042

[45] Jan. 18, 1977

[54] METHOD FOR APPLYING A WEAR AND IMPACT RESISTANT COATING

[75] Inventor: Thomas E. Fairbairn, Westland, Mich.

[73] Assignee: Sirius Corporation, Toledo, Ohio

[22] Filed: Mar. 7, 1975

[21] Appl. No.: 556,247

[52] U.S. Cl. ..... 427/34; 427/46; 427/53; 427/318; 427/376 R

[51] Int. Cl.[2] ..... B05D 1/10; B05D 3/00; B05D 1/36; B05D 7/14

[58] Field of Search ..... 427/34, 53, 46, 318, 427/327, 376, 423

[56] References Cited

UNITED STATES PATENTS

| | | | |
|---|---|---|---|
| 2,861,900 | 11/1958 | Smith et al. | 427/423 |
| 3,254,970 | 6/1966 | Dittrich et al. | 427/423 X |
| 3,310,423 | 3/1967 | Ingham et al. | 427/423 X |
| 3,648,015 | 3/1972 | Fairbairn | 427/34 X |

FOREIGN PATENTS OR APPLICATIONS

| | | | |
|---|---|---|---|
| 867,455 | 5/1961 | United Kingdom | 427/423 |

*Primary Examiner*—James R. Hoffman
*Attorney, Agent, or Firm*—Cullen, Settle, Sloman & Cantor

[57] ABSTRACT

A base metal is coated with a wear and impact resistant material comprising a mixture of tungsten carbide powder and nickel chrome boron powder which is spray applied by means of a stream of energy. This coating is thereafter covered by a thin layer of nitrogen-carried boric acid or boric oxide powder, forming a glossy protective film prior to fusing of the entire coating at elevated temperature.

11 Claims, No Drawings

METHOD FOR APPLYING A WEAR AND IMPACT RESISTANT COATING

CROSS-REFERENCE TO RELATED APPLICATIONS

This invention includes information disclosed and claimed in one or both of my applications, Ser. No. 760,074, filed Sept. 16, 1968, and Ser. No. 888,948, filed Dec. 29, 1969, both now abandoned.

DETAILED DESCRIPTION OF INVENTION

The coating which is applied to the base material according to this invention generally comprises a mixture of tungsten carbide and nickel chrome boron, each in a commercially available 120 mesh powdered form prior to application. The tungsten carbide which has been successfully used in this process is manufactured by Stoody Co. of Whittier, California under the trademark "BORIUM", and is in a non-sintered, cast and crushed highly pure form. The nickel chrome boron used is manufactured by Colmonoy Co. of Detroit, Michigan and referred to as "spray weld powder No. 6" or "fuse weld powder No. 63" if a harder matrix is required.

The tungsten carbide contributes the desired hardness and wear resistance, while the lower melting point nickel chrome boron acts as a matrix to prevent crumbling and to hold the tungsten carbide particles in place on the base material while the tungsten carbide is in the plastic stage prior to plasma fusing.

The preferred mixture is 45% tungsten carbide by volume, and 55% nickel chrome boron. The proportion of tungsten carbide can vary, however, from 15 to 75%. If the amount of tungsten carbide is too low, the desired hardness and wear and impact properties are lost, while too great a concentration of tungsten carbide is difficult to bond and retain in place and tends to shatter under impact. The preferred formulation produces the optimum combination of hardness, wear and impact resistance, and strength of bond.

A powder in the form of a tungsten carbide nucleus encapsulated by nickel chrome boron could be used. This form reduces the chance of dissolution of the tungsten carbide which could occur during application if a non-inert atmosphere were used and if high temperatures were maintained for too long a period.

These powdered materials are applied to the base to be coated by a plasma-generating gun. The technique which will be described involves the use of equipment manufactured by Metco of Westbury, Long Island, N.Y., the gun being Model 3MB, the power feed being Model 3MP, and the control being Model 2MC.

Alternatively, the powdered materials may be applied through the use of an energy beam generating system as described in my U.S. Pat. No. 3,648,015, including the use of the Improved Nozzle as disclosed in my copending application Ser. No. 418,721, filed Nov. 23, 1973 now U.S. Pat. No. 3,894,209 of July 8, 1975, or through the use of a laser-energy beam system as described in my copending application Ser. No. 409,167, filed Oct. 24, 1973 now U.S. Pat. No. 3,872,279 of March 18, 1975. The principles of the present invention are the same regardless of the specific apparatus used. Hence the word "gun" refers to each of these, and the "plasma" is functionally equivalent to the beam generated by the apparatus described in these other patents and applications. Thus the phrases "stream" and "stream of energy" will be used generically to refer to any and all of these systems.

Prior to application of the powder, the base material must first be thoroughly cleaned. The base material would most likely be steel, though other suitable bases such as aluminum might be employed depending upon the desired properties and contemplated environment of use. A process especially adapted for coating aluminum is described hereinafter. Cleaning is effectively accomplished by a grit blast using aluminum oxide particles, for example.

The tungsten carbide and nickel chrome boron powder feed for the gun is turned on, and the gun is held at a range to six or seven inches from the cleaned and roughened steel surface. Care must be taken not to preheat the bare steel base past its blue flash oxidation point (approximately 300° F) prior to the application of the coating with the gun.

The preferred settings for the equipment are as follows: G nozzle No. 1 powder port S meter wheel; 25 r.p.m. on the powder feed which equals 66 on the standard Metco vibrator type powder feed unit dial; meter reading of 37 on the carrier gas flow rate gauge located on the powder feed unit; the nitrogen carrier gas gauge on the powder feed control unit set at 150; the flow meter for the hydrogen plasma gas set at 5; the feed pressure for both the nitrogen and the hydrogen set at 51 p.s.i.; and the direct current arc for the gun set at 500 amps and 51 volts.

The nitrogen acts as a coolant and also floods the work area with a protective environment which prevents oxidation and dissolution of the tungsten carbide. The hydrogen and the distance of the main plasma core control the plasma temperature.

At a distance of six to seven inches, the gun is then panned across the surface to be coated in order to avoid hot spots, and to apply a thin oxidation-preventing coating over the entire piece, until a coating build-up of 0.020–0.030 inch is obtained. If desired, a heavier coating may be applied. This technique produces a good but thin bond without the need for the prior application of a bond-enhancing material. It is thought that the nickel chrome boron and tungsten carbide react with each other in the plasma stream prior to impact on the steel base, producing an exothermic reaction in the stream and at the metal surface which generates sufficient heat to raise the skin temperature of the base at the interface to the 1925° F fusing temperature.

When the desired thickness is achieved, the powder feed is shut off, but the stream of energy is maintained to retain the heat and block oxidation from the atmosphere.

At this time a boric acid or boric oxide ($B_2O_3$) spray (sodium tetraborate anhydride) is applied with the stream to the coated surface. The feed is at 1 p.s.i. with a vibrator type powder feed unit using nitrogen as a carrier gas, and the spray comes out of a dual nozzle that converges about 8 inches ahead of the nozzle (i.e., in the cooler part of the stream) so as to avoid evaporation of the powder. The stream is backed off to about 9 inches. The boric oxide melts upon contact with the surface, and only enough is applied to cover the coated surface until it has a wet appearance. The purpose of this application is to create a glass-like protective coating to prevent oxidation and other impurities during subsequent stream of energy fusing of the tungsten carbide and nickel chrome boron coating.

Following application of the boric acid or boric oxide, the flow rate of the hydrogen gas is increased to a setting of 20–25, and the current is readjusted to maintain 500 amps. The gun is moved slowly in a range of 1 inch to apply the hottest part of the stream of energy to fuse the coating and the upper strata of the steel base into a homogeneous mass. This requires a surface temperature which closely approaches the melting point of the Borium (tungsten carbide) i.e., 4500° F plus or minus 300° F. At such temperature, some dissolution of the tungsten carbide is possible, and accordingly it is advisable to spray an additional 0.001 – 0.002 inch coating of aggregate when the fusing temperature is reached in order to replace any dissoluted tungsten carbide. This temperature should be maintained for no longer than 30 seconds, in order to minimize dissolution of the coating. Too low a temperature fails to achieve the extraordinarily strong metallurgical bond which can otherwise be obtained.

Products coated according to this method are highly resistant to wear and impact, making them useful in applications such as seals, jewelry, gear teeth and armor. A highly homogeneous product is achieved, which can be polished to a mirror-like surface, while retaining a Rockwell C hardness of 60–94. Indicative of the properties which have been achieved are the results of the following series of tests.

A 1/16 inch thick steel panel having a coating of 0.020 inches was shot at with a 0.45 caliber pistol at a range of 25′ without penetration and without separation of the bond between coating and base.

A similar hand-held panel stalled a power grinding wheel with negligible wear.

A similar panel was bent through an arc of 170 degrees over a vise jaw by blows from a heavy ball peen hammer to an inside radius of one-fourth inch, with the coated side on the outside of the bend. The coating cracked from stretching, but did not separate from the base.

The use of this unique method permits a 0.030 inch coating to be applied to a 1½ inch square 1/16 inch thick panel in only five seconds by only a single gun, with no need to separately apply individual layers of different powders or of a preliminary bond-enhancing coating, excepting only the boric oxide protective coating. Furthermore, there are no interruptions which would permit the surface to cool down.

As an alternative method, following application of the boric oxide, the workpiece can be run through a gas or electric fired furnace at 1925° F. No atmospheric control of the furnace is required, and faster and more uniform fusing can be achieved on a production basis. This method may be adequate where less severe impacts are contemplated. If higher properties are required, the workpiece may thereafter be subjected to the plasma stream at 4500° F. as described above to attain the metallurgical bond and homogeneous result.

If desired, Borax (sodium tetraborate decahydrate) can be used in place of the boric oxide.

COATING OF ALUMINUM BASE

Where the coating is to be applied to an aluminum base, a nickel-aluminum composite matrix for the tungsten carbide has been found to be effective. The optimum proportion is 45% tungsten carbide by volume and 55% nickel-aluminum by volume, both in approximately 200–400 fine mesh powdered form. As in the case of the nickel-chrome-borom coating described above, the proportion of tungsten carbide can vary between 15–75%. Preliminary tests suggest that finer mesh size will produce a better finish and stronger bond. The tungsten carbide which has been successfully used is again the "BORIUM" product of the Stoody Company of Whittier, California, while the nickel-aluminum which has been used is the Metco 450 powder of Metco of Westbury, Long Island, N.Y. The two powders should be throughly premixed prior to spraying.

The aluminum base should be normalized (softened) by conventional procedures or with the stream of energy prior to application of the coating, since this has been found to result in a deeper zone of coating penetration and a stronger interlock or bond between the coating and base. Next, the aluminum base should be mechanically grooved and/or cleaned by grinding with coarse aluminum oxide, and it is important that the roughened and cleaned surface be coated promptly thereafter to prevent oxidation of the surface.

The normalized and cleaned aluminum base is then sprayed directly, in a cold condition, using the same equipment and settings as described above. Care should be exercised to prevent the aluminum from heating above 300° F. during the application of the energy spray process, to avoid oxidation and resultant loss of bond strength and penetration. To keep the temperature down, the gun should be held at a range of 9–12 inches from the work. Coating thicknesses of 0.015 – 0.020 inch have been successfully applied and tested, though coatings up to 0.060 inch may be also used. Following application of the boric oxide or Borax, and in place of the 4500° fusing step employed when coating a steel base, the coated aluminum is similarly heated to about 950° F. for a few seconds with the energy stream and then quenched in cold water. This step functions to improve the mechanical bond between coating and base and to harden the aluminum.

Specimens made in accordance with this process have been heated to 950° F. for one hour and water quenched without separation of the coating from the base. A hammer blow will not break off the coating, which has an average Rockwell C hardness of 55 or higher over a one square centimeter area. While the ultimate properties depend upon the subsequent heat treatment, if any, of the base, a coated base will have about 15% greater impact resistance than a comparably treated undercoated base. The coated aluminum will have comparable wear resistance to a non-coated high carbon steel. A 1 inch aluminum panel with a coating of 0.020 inch has resisted penetration of a 0.45 caliber bullet at a 25 feet range without separation of the bond between coating and base.

This invention may be further developed within the scope of the following claims. Accordingly, the above specification is to be interpreted as illustrative of only three operative embodiments of this invention, rather than in a strictly limited sense.

I now claim:

1. The improved method of applying a wear and impact resistant coating to a base material comprising the steps of:

electrically generating a stream of energy having the capability of heating the base material and the coating mixture sufficiently to create a bond therebetween;

introducing into said stream a mixture of tungsten carbide and a lower melting point matrix-forming material, both in powdered form;

applying said mixture containing stream to the base material to create a coating thereon;

applying by means of said stream, immediately after application of said mixture and without withdrawal of said stream, an additional oxidation-preventing coating prior to fusing; and thereafter fusing said coatings to the base material at an elevated temperature.

2. The method of claim 1 wherein said final fusing is obtained by application of said stream of energy to the coated base material to heat the surface to approximately 4,500° F. for up to 30 seconds.

3. The method of claim 1 wherein said matrix-forming material is nickel-chrome-boron.

4. The method of claim 1 wherein said matrix-forming material is nickel-aluminum.

5. The method of claim 1 and including the preliminary step of softening the base material by heat prior to introducing said mixture into said stream of energy.

6. The method of claim 1 and including the steps of roughening and cleaning the base material prior to applying said mixture containing stream to said base material.

7. The method of claim 1 wherein said final fusing includes the steps of application of said stream of energy to the coated base material to heat the surface to approximately 950° F. and then quenching the coated base material in cold water.

8. The method of claim 1 wherein said stream of energy is a plasma flame.

9. The method of claim 1 wherein said stream of energy is an energy beam.

10. The method of claim 1 wherein said stream of energy is a combined laser-energy beam.

11. The method of claim 1 wherein said additional oxidation preventing coating is selected from the group consisting of: boric acid, boric oxide, sodium tetraborate anhydride, and sodium tetraborate decahydrate.

* * * * *